US006456224B1

(12) United States Patent
Cobb et al.

(10) Patent No.: US 6,456,224 B1
(45) Date of Patent: Sep. 24, 2002

(54) EDGE CONCEALMENT SYSTEM FOR ABATING RADAR DETECTABILITY OF AIRCRAFT

(75) Inventors: Hal Michael Cobb, Palmdale; Wayne William Schmidt, Placentia; Peter A. Peraldo, Bellflower; Daniel E. Suh, Irvine; Anthony Cazzato, Torrance, all of CA (US)

(73) Assignee: Northrop GrummanCorporation, Los Angeles, CA (US)

( * ) Notice: Subject to any disclaimer, the term of this patent is extended or adjusted under 35 U.S.C. 154(b) by 0 days.

(21) Appl. No.: 09/899,712

(22) Filed: Jul. 5, 2001

(51) Int. Cl.[7] ..... H01Q 17/00

(52) U.S. Cl. ..... 342/2; 342/1; 342/3; 342/4; 342/13; 342/198

(58) Field of Search ..... 342/13, 1–4, 198

(56) References Cited

U.S. PATENT DOCUMENTS 3,737,903 A * 6/1973 Suetake et al. ..... 342/1
4,038,660 A * 7/1977 Connolly et al. ..... 342/1
5,570,092 A * 10/1996 Kohin-Nitschelm ..... 342/1

* cited by examiner

*Primary Examiner*—Thomas H. Tarcza
*Assistant Examiner*—Isam Alsomiri
(74) *Attorney, Agent, or Firm*—Stetina Brunda Garred & Brucker

(57) ABSTRACT

An edge concealment system for abating electrical discontinuities between externally exposed edges of adjacent surface pieces separated by a gap. The system includes a cover component shrouding each edge and able to absorb or conduct incident radar energy. A male element and a female element extend between the cover component and the surface piece for positive engagement of the male element within the female element and retention of the cover component with the surface piece. Preferably the engagement of the male and female elements includes an audible signal such as a click sound when the engagement occurs so that operators are confirmatively advised upon positive placement.

8 Claims, 1 Drawing Sheet

EDGE CONCEALMENT SYSTEM FOR ABATING RADAR DETECTABILITY OF AIRCRAFT

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates in general to the concealment of adjacent edges of structural pieces, and in particular to an edge concealment system for abating electrical discontinuities between externally exposed edges of adjacent surface pieces separated by a gap wherein an edge cover component is secured in place to conceal the edges with cooperating male interlock and female interlock mechanisms extending between the edge cover component and the structural piece itself.

Many modern military aircraft incorporate some type of surface treatment that provides radar cross section reduction to thereby transform these aircraft into "low observable" or "stealth" airplanes. Generally, these treatments employ materials that absorb or conduct incident radar energy, and typically include adhesive bonding or spray-paint-like processes for material adherence. Where materials (e.g. caulks, paints, adhesives) requiring a wet application are used, inherent undesirable requirements include surface preparation, mixing, cure time, presence of volatiles and hazardous materials, use of personal protection devices, and acquisition of special application equipment. In addition to being quite inconvenient, the application of these materials requires an inordinate amount of time at both the manufacturing event and at any repair event in the field. Correspondingly, because of these time factors, labor expenses escalate significantly.

In as much as a rapid, yet completely effective and long-lasting, enshrouding requirement exists for concealing adjacent but spaced edges from radar detection in both initial manufacture as well as repair of affected surface areas, a primary object of the present invention is to provide an edge concealment system whose components cooperatively interact with surfaces at gap sites to obstruct gap edges from detection.

Another object of the present invention is to provide an edge concealment system wherein a cover component conceals surface-piece edges and is anchored in place by a receiver disposed within a surface site of the surface piece.

Yet another object of the present invention is to provide an edge concealment system wherein cover component anchoring is confirmed through a audible signal.

These and other objects of the present invention will become apparent throughout the description thereof which now follows.

BRIEF SUMMARY OF THE INVENTION

The present invention is an edge concealment system for abating electrical discontinuities between externally exposed edges of adjacent gap-separated surface pieces such as those of an aircraft. The system first includes cover components having a size sufficient for shrouding the exposed edges of the adjacent surface pieces. Typical material used to fabricate the cover component must be able to absorb or conduct incident radar energy. The system additionally includes a male element and a female element extending between the cover component and the surface piece for positive engagement of the male element within the female element and consequent retention of the cover component with the surface piece. In one embodiment the male element projects from each cover component and the female element is formed into a site of each of the adjacent surface pieces. It is to be understood, of course, that the male/female elements can be reversed such that the cover component possesses the female element and the surface piece possesses the male element. These male and female elements have respective cooperating male interlock and female interlock mechanisms for positive engagement of the male element within the female element. For ease of alignment of male and female elements during cover-component placement, the male element preferably projects substantially perpendicularly from the cover component and is situated substantially midway along the length of the cover component. Positive engagement of the cooperating male interlock and female interlock mechanisms preferably also includes an audible signal such as a click sound when the interlock occurs so that operators are confirmatively advised upon positive placement. Once the edge concealment system is in place, radar detectability is significantly abated as compared to non-concealed surface edges. Initial cover component placement as well as removal and replacement in the field can be accomplished rapidly, while confident retention of the cover components in surface-mounted placement efficiently continues during use such as in the flight of so-protected aircraft.

BRIEF DESCRIPTION OF THE DRAWINGS

An illustrative and presently preferred embodiment of the invention is shown in the accompanying drawings in which.

DETAILED DESCRIPTION OF PREFERRED EMBODIMENTS

Figure 1:
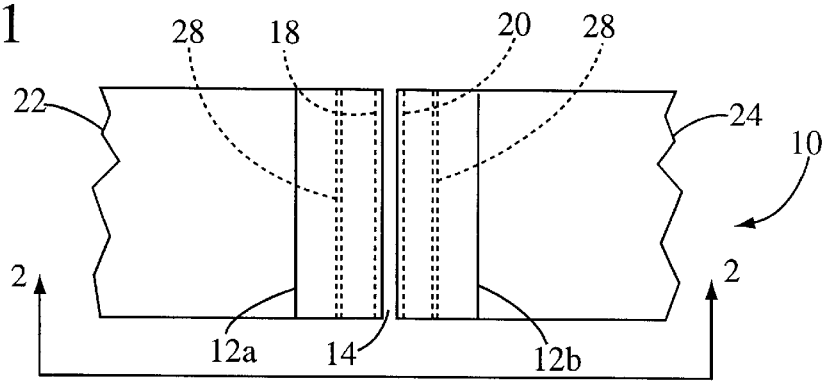
FIG. 1 is a top plan view of a portion of an aircraft surface showing respective adjacent edges of respective portions of two surface pieces with a gap between the edges and an edge concealment system in place according to the present invention.
Figure 2:
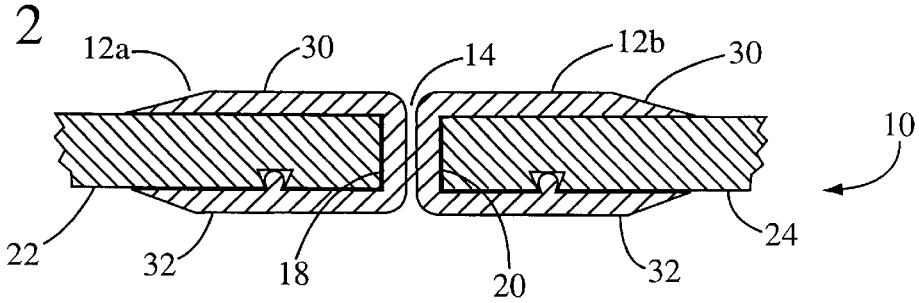
FIG. 2 is a side elevation view in section along line 2—2 of FIG. 1.
Figure 3:
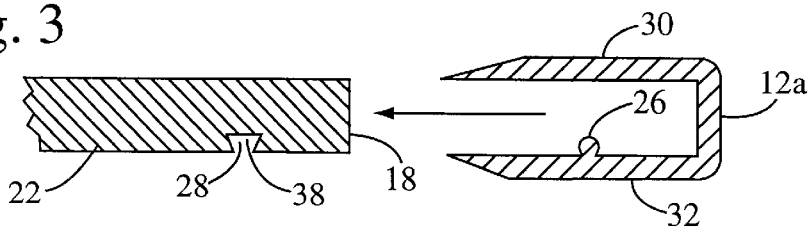
FIG. 3 is a side elevation view in section of one cover component and structure piece of FIG. 2 prior to cover component placement.
Figure 4:
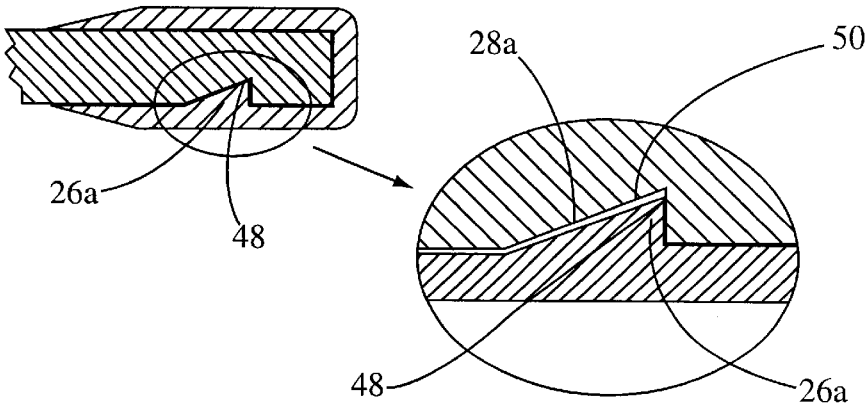
FIG. 4 is a side elevation view in section of a second embodiment of a cover component and structure piece in engagement with each other.

Referring first to FIGS. 1–3, an edge concealment system 10 is illustrated. The system 10 includes two cover components 12*a*, 12*b* configured substantially as U-shape members and of a size sufficient for covering and concealing exposed edges 18, 20 of adjacent structural surface pieces 22, 24 such as those of a surface of an airplane and separated by a gap 14. The cover components 12*a*, 12*b* are fabricated of a material able to absorb or conduct incident radar energy to thereby interfere with radar detection of an aircraft so provided and as otherwise detectable because of discontinuities of surface area due to exposed edges 18, 20 of the adjacent surface pieces 22, 24. Attachment of the cover components 12*a*, 12*b* is accomplished by cooperatively interlocking respective male and female elements 26 and 28 of the respective cover components 12*a*, 12*b* and surface pieces 22, 24. In particular, a dove-tail shaped male element 26 projects inwardly from each cover component 12*a*, 12*b* and a female element 28 is positioned at a complimentary surface site of the respective surface pieces 22, 24. The male element 26 projects substantially perpendicularly between the two arms 30, 32 of each respective cover components 12*a*, 12*b*, and is preferably situated about midway along the length of the arm 30. The interlock mechanism of the female element 28 is a notch 38 into a site of each of the adjacent surface pieces 22, 24 and positioned such that the male and female elements are in alignment when a cover element is in final-placement position. FIG. 4 illustrates a second embodiment of male/female elements. Specifically, the male element 26*a* is a ramped saw-tooth shaped protrusion while the female element 28*a* is a ramped hook 50 which engages the saw-tooth protrusion 48 as shown in place in FIG. 4. Upon engagement of the male and female elements 26, 28 or 26*a*, 28*a* with each other, an audible click sound is emitted as the male element 26, 26*a* is accepted by the respective female element 28, 28*a*. As is apparent, the female elements 28, 28*a* provide sufficient deformation flexibility and memory to permit male element entry.

In use, and in reference specifically to FIG. 3, the cover component 12*a* is positioned to slide over the edge 18 of the surface piece 22 in the direction of the arrow to thereby conceal said edge. Upon full placement of the cover component 12*a*, the dove-tail shaped male element 26 aligns with and enters the female element 28 (notch 38), at which time an audible click sound occurs due to such entry and functions to confirm secure installation. In this manner, rapid manufacture and repair can be accomplished without complicated and lengthy processes incorporating standard fill-and-cure ingredients and procedures.

While an illustrative and presently preferred embodiment of the invention has been described in detail herein, it is to be understood that the inventive concepts may be otherwise variously embodied and employed and that the appended claims are intended to be construed to include such variations except insofar as limited by prior art.

What is claimed is:

1. An edge concealment system for abating electrical discontinuities between externally exposed edges of adjacent surface pieces separated by a gap, the system comprising:

a) a cover component for each exposed edge, said component having a size sufficient for shrouding the exposed edge of each adjacent surface piece and fabricated of a material able to absorb or conduct incident radar energy; and b) a male element and a female element extending between the cover component and the surface piece for positive engagement of the male element within the female element and retention of the cover component with the surface piece.

2. An edge concealment system as claimed in claim 1 wherein the male element projects substantially perpendicularly from a site of the cover component.

3. A gap coverage system as claimed in claim 1 wherein the cover component is substantially U-shape.

4. An edge concealment system as claimed in claim 1 wherein the male element and female element produce an audible signal upon engagement with each other.

5. An edge concealment system as claimed in claim 1 wherein the male element is a dovetail protrusion projecting from a site of the cover component and the female element is a notch within a wall site of the structure piece and situated to accept and retain the dovetail protrusion when the male and female elements are engaged.

6. An edge concealment system as claimed in claim 5 wherein the male and female elements produce an audible signal upon engagement with each other.

7. An edge concealment system as claimed in claim 1 wherein the male element is a sawtooth protrusion projecting from a site of the cover component and the female element is a hook within a wall site of the structure piece and situated to accept and retain the sawtooth protrusion when the male and female elements are engaged.

8. An edge concealment system as claimed in claim 7 wherein the cooperating male and female elements produce an audible signal upon engagement with each other.

* * * * *